US006653994B2

(12) United States Patent
Takeda et al.

(10) Patent No.: US 6,653,994 B2
(45) Date of Patent: Nov. 25, 2003

(54) PLASMA DISPLAY PANEL DISPLAY DEVICE AND DRIVE METHOD

(75) Inventors: Minoru Takeda, Takatsuki (JP); Shinji Masuda, Ibaraki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 233 days.

(21) Appl. No.: 09/935,989

(22) Filed: Aug. 23, 2001

(65) Prior Publication Data

US 2002/0075206 A1 Jun. 20, 2002

(30) Foreign Application Priority Data

Aug. 24, 2000 (JP) ..... 2000-253724

(51) Int. Cl.[7] ..... G09G 3/88
(52) U.S. Cl. ..... 345/60; 345/66; 345/68
(58) Field of Search ..... 345/60, 62, 63, 345/66, 67, 68, 71; 315/169.3, 169.4

(56) References Cited

U.S. PATENT DOCUMENTS 5,745,086 A 4/1998 Weber
6,483,251 B2 * 11/2002 Setoguchi et al. ..... 315/169.4

FOREIGN PATENT DOCUMENTS

| | | |
|---|---|---|
| EP | 965975 | 12/1999 |
| JP | 2000-75835 | 3/1999 |

* cited by examiner

*Primary Examiner*—Dennis-Doon Chow

(57) ABSTRACT

To provide a PDP display device and a drive method which use a set-up pulse having a portion that drops in voltage at a rate of 2V/μsec or more, whereby the occurrence of discharge errors in a sustain period can be suppressed even when wall charges are not sufficiently erased in an erase period and excess wall charges remain on some or all electrodes in a set-up period. To this end, the drop portion of the set-up pulse applied to a scan electrode group is set after a pulse applied to a sustain electrode reaches a voltage which does not cause a discharge between the sustain and scan electrodes. As a result, the occurrence of discharge errors in the sustain period is suppressed, without prolonging the set-up period.

19 Claims, 6 Drawing Sheets

PLASMA DISPLAY PANEL DISPLAY DEVICE AND DRIVE METHOD

This application is based on application No. 2000-253724 filed in Japan, the content of which is hereby incorporated by reference.

BACKGROUND OF THE INVENTION

1. Field of the Invention

The present invention relates to a plasma display panel display device, and a drive method for use in a plasma display panel display device.

2. Related Art

In recent years, there have been high expectations for large-screen display devices with superior picture quality such as high-definition displays. Hence research is being performed into a variety of display devices, such as CRTs (cathode ray tubes), LCDs (liquid crystal displays), and PDPs (plasma display panels).

Among these display devices, PDPs are best suited for large-screen use, with sixty-inch models already having been developed.

Especially, surface discharge AC (alternating current) PDPs, which are suitable for large-screen use, are prevalent at present.

A surface discharge AC PDP has the following construction. A front panel and a backpanel are opposed to each other with barrier ribs interposed therebetween. A discharge gas is enclosed in a discharge space which is partitioned by the barrier ribs.

Typically, scan electrodes and sustain electrodes are arranged in the form of stripes on a main surface of the front panel. A dielectric layer made of glass is formed on the front panel so as to cover the scan and sustain electrodes, and a protective layer is formed on the dielectric layer.

On the other hand, data electrodes are arranged in the form of stripes on a main surface of the back panel which faces the front panel. A dielectric layer made of glass is formed on the back panel so as to cover the data electrodes, and the barrier ribs are formed on the dielectric layer in parallel with the data electrodes. Phosphor layers of red, green, and blue are applied in turn to channels that are formed by the barrier ribs and the dielectric layer.

To drive this surface discharge AC PDP, drive circuits are used to apply pulses between electrodes based on input image data, to cause a write discharge for writing the image data and a sustain discharge for sustaining a discharge. The sustain discharge causes emission of ultraviolet light from the discharge gas. This ultraviolet light is absorbed by the particles of red, green, and blue phosphors in the phosphor layers, which results in excited emission of light.

Discharge cells in such a surface discharge AC PDP are fundamentally only capable of two display states, ON and OFF. Accordingly, a field timesharing gradation display method is typically adopted whereby one field for each color is divided into multiple sub-fields each having a predetermined light emission period and a gray scale is expressed by the combination of the sub-fields. For image display in each sub-field, an ADS (address display-period separation) method is employed whereby a series of operations of writing data in a write period and sustaining a discharge in a sustain period are carried out. In this drive method, a set-up period for applying set-up pulses is usually provided at the beginning of each field or each sub-field, so as to stabilize the write operation.

As a set-up pulse, a pulse of a typical rectangular waveformor a pulse of a ramp waveform, which is disclosed in U.S. Pat. No. 5,745,086 (Weber), is used. The ramp waveform is described in detail by Larry F. Weber "Plasma Display Device Challenges" in ASIA DISPLAY 98, pp.23–27.

A pulse that combines ramp waveforms with sharp voltage rise and drop portions, which is disclosed in PCT International Publication No. WO 00/30065 (Hibino), is also used as a set-up pulse.

A set-up period that uses this waveform combination is described in detail below, by referring to FIG. 6.

As shown in the drawing, a drive circuit maintains a data electrode group D and a sustain electrode group SUS at 0(V), during the first part of the set-up period. Meanwhile, after a sharp rise from 0(V) to Vp(V) (a voltage which does not cause a discharge with the sustain electrode group SUS or the data electrode group D), a voltage of a ramp waveform (hereafter "ramp voltage") that gradually rises to Vr(V) (a voltage which causes a discharge with the sustain electrode group SUS) is applied to a scan electrode group SCN. While the ramp voltage is being applied, a first weak set-up discharge occurs between the scan and data electrode groups and between the scan and sustain electrode groups, in each discharge cell. As a result, negative wall charges are accumulated on the part of the protective layer that covers the scan electrode group SCN, whereas positive wall charges are accumulated on the part of the dielectric layer which covers the data electrode group D and on the part of the protective layer which covers the sustain electrode group SUS.

After this, the drive circuit sharply decreases the voltage applied to the scan electrode group SCN, from Vr(V) to Vq(V) (a voltage that does not cause a discharge with the sustain electrode group SUS or the data electrode group D).

In the second part of the set-up period, while holding the scan electrode group SCN at Vq(V), the drive circuit sharply increases the voltage applied to the sustain electrode group SUS from 0(V) to Vh(V) (a positive voltage which does not cause a discharge with the scan electrode group SCN or the data electrode group D). The sustain electrode group SUS is held at Vh(V) afterwards.

With the sustain electrode group SUS being held at Vh(V), the drive circuit decreases the voltage applied to the scan electrode group SCN from Vq(V) to Vb(V) (a voltage which causes a discharge with the sustain electrode group SUS), in the form of a ramp. When the voltage applied to the scan electrode group SCN is dropping to Vb(V) while the voltage applied to the sustain electrode group SUS is kept at Vh (V), a second weak set-up discharge occurs between the sustain and scan electrode groups in each discharge cell.

As a result, the negative wall charges accumulated on the protective layer over the scan electrode group SCN and the positive wall charges accumulated on the protective layer over the sustain electrode group SUS are weakened, whereas the positive wall charges accumulated on the dielectric layer over the data electrode group D remain as they are.

In the set-up pulse shown in FIG. 6, the ramp waveforms facilitate accumulation of wall charges, whereas the sharp voltage rise and drop portions serve to shorten the set-up period. Thus, by using such a set-up pulse that combines ramp waveforms with sharp voltage rise and drop portions, a set-up can be carried out where sufficient wall charges are accumulated without prolonging the set-up period.

Also, the rise of the voltage applied to the sustain electrode group SUS from 0(V) to Vh(V) enhances the effect of shortening the set-up period.

At the end of each field, an erase period is provided for erasing accumulated wall charges. Here, the wall charges are sometimes not able to be sufficiently erased in the erase period, depending on illumination conditions. This being so, if the above set-up pulse that has the steep voltage drop portion (with a rate of change of 2V/μsec or more) is used, a first undesired discharge (hereinafter "discharge error") occurs at E1 in FIG. 6, in the cells where the wall charges were not sufficiently erased in the erase period. In these cells where the discharge error occurs at E1, second and third discharge errors are likely to follow at E2 and E3.

Especially, the discharge error at E3 has the same effect as the write discharge in the write period following the set-up period, thereby causing a discharge error in the sustain period (i.e. the occurrence of sustain discharge in the cells to which data should not be written).

Though such a discharge error in the sustain period does not occur in each field but rather takes place once every several tens fields per cell, still it is easily noticeable to the human eye unlike other discharges occurring in the set-up period or the like. As a result, the image quality will end up deteriorating.

Thus, in the conventional PDP drive method that uses a set-up pulse having a portion where a voltage drops at a rate of 2V/μsec or more, if wall charges remain after the erase period, discharge errors occur in the set-up period, which induces discharge errors in the sustain period.

SUMMARY OF THE INVENTION

In view of the above problem, the present invention aims to provide a plasma display panel display device and a drive method that use a set-up pulse having a portion in which a voltage drops at a rate of 2V/μsec or more, whereby the occurrence of discharge errors in the sustain period can be suppressed even if wall charges are not sufficiently erased in the erase period and excess wall charges remain on some or all electrodes.

To this end, the plasma display panel display device and drive method of the present invention are constructed so that: a pulse applied to a first row electrode in a set-up period includes a drop portion in which the pulse decreases in voltage at a rate no smaller than 2V/μsec; and a pulse applied to a second row electrode in the set-up period includes the following portions in the stated order: a first portion in which the pulse increases to a predetermined voltage before the drop portion starts, the predetermined voltage being a voltage which does not cause a discharge between the first and second row electrodes; and a second portion in which the pulse is held at the predetermined voltage after the drop portion starts.

According to the conventional method, the voltage applied to the first row electrode is sharply decreased while the potential difference between the first and second row electrodes is large. According to the present invention, on the other hand, the voltage applied to the second row electrode is increased to the voltage which does not cause a discharge between the first and second row electrodes, before the sharp drop of the voltage applied to the first row electrode. Which is to say, the voltage applied to the first row electrode is decreased while the potential difference between the first and second row electrodes is small. In this way, the occurrence of discharge errors in the set-up period is suppressed. Hence the occurrence of discharge errors in the sustain period can be suppressed with no need to prolong the set-up period.

In more detail, the pulse applied to the first row electrode in the set-up period includes the following portions in the stated order: a third portion in which the pulse increases from a first voltage to a second voltage, the first voltage being a voltage that does not cause a discharge between the first and second row electrodes, and the second voltage being a voltage that causes a discharge between the first and second row electrodes; a fourth portion in which the pulse is held at the second voltage; and a fifth portion which includes the drop portion and in which the pulse decreases from the second voltage to a third voltage, the third voltage being a voltage that causes a discharge between the first and second row electrodes in a direction opposite to the discharge caused by the second voltage. Also, the pulse applied to the second row electrode in the set-up period includes the first portion which overlaps in time with at least one of the third portion and the fourth portion, and in which the pulse increases from a fourth voltage to the predetermined voltage, the fourth voltage being a voltage that causes a discharge between the first and second row electrodes.

Here, at least one of the first, third, and fifth portions preferably includes a ramp waveform, an exponential waveform, or a combination of ramp waveforms having different voltage change rates, so as to suppress discharge errors in the set-up period effectively.

BRIEF DESCRIPTION OF THE DRAWINGS

These and other objects, advantages and features of the invention will become apparent from the following description thereof taken in conjunction with the accompanying drawings which illustrate specific embodiments of the invention.

In the drawings.

DESCRIPTION OF THE PREFERRED EMBODIMENT

Figure 1:
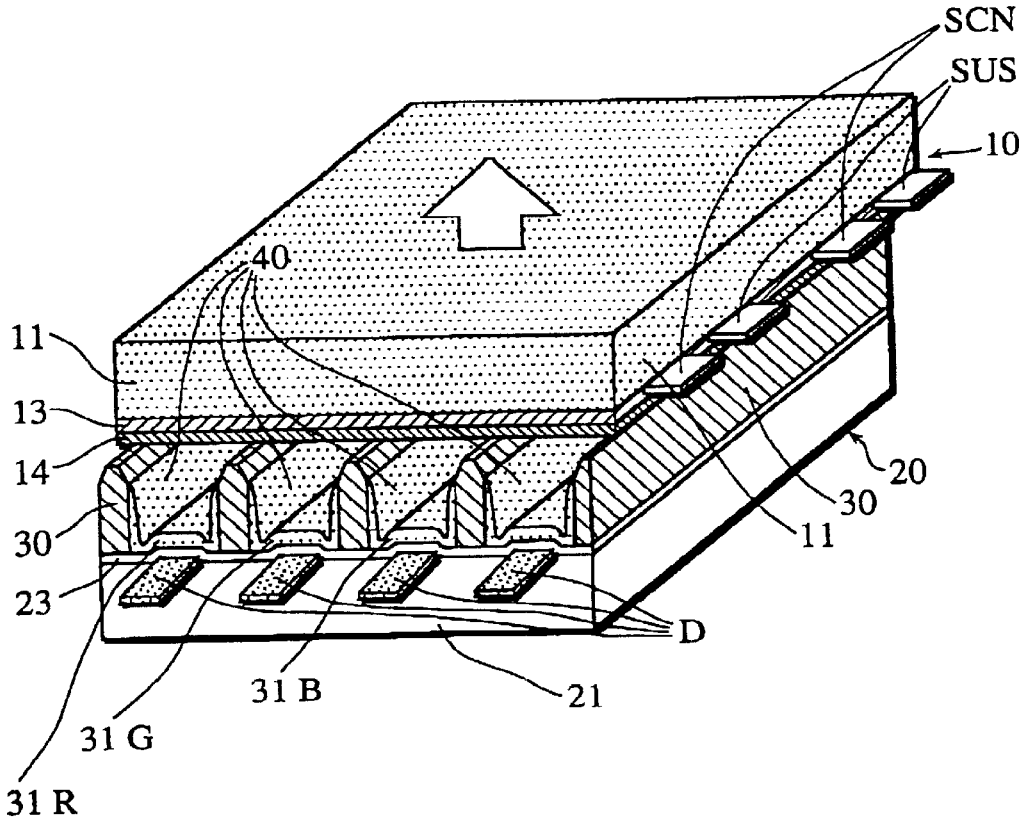
FIG. 1 is a partial perspective and sectional view showing a rough construction of a surface discharge AC PDP.

FIG. 1 is a partial perspective and sectional view showing a rough construction of a surface discharge AC PDP (hereafter simply referred to as "PDP") to which the embodiment of the invention relates.

As shown in the drawing, the PDP in this embodiment has a construction where a front panel 10 and a back panel 20 are opposed to each other with a gap in between.

In the front panel 10, a scan electrode group SCN, a sustain electrode group SUS, a dielectric layer 13, and a protective layer 14 are disposed on a front glass substrate 11.

In the back panel 20, a data electrode group D and a dielectric layer 23 are disposed on a back glass substrate 21.

The gap between the front panel 10 and the back panel 20 is partitioned by stripe barrier ribs 30, to form discharge spaces 40. A discharge gas (e.g. Ne—Xe or He—Xe) is enclosed in the discharge spaces 40.

Also, phosphor layers 31R, 31G, and 31B of red, green, and blue are applied in turn to the channels formed by the dielectric layer 23 and the barrier ribs 30, in the back panel 20.

The scan electrode group SCN, the sustain electrode group SUS, and the data electrode group D are each arranged in the form of stripes. The scan electrode group SCN and the sustain electrode group SUS are set so as to cross over the barrier ribs 30, while the data electrode group D is set perpendicular to the barrier ribs 30.

Each electrode group may be formed simply from metal such as gold (Au), silver (Ag), copper (Cu), chromium (Cr), nickel (Ni), or platinum (Pt). To secure a large discharge area in each cell, however, it is preferable to use compound electrodes in which a silver (Ag) electrode is placed on a wide transparent electrode made of a conductive metal oxide such as ITO, $SnO_2$, or ZnO, for the scan electrode group SCN and the sustain electrode group SUS. Cells that emit light of the colors red (R), green (G), and blue (B) are formed where the scan electrode group SCN and the sustain electrode group SUS cross over the data electrode group D.

The dielectric layer 13 is formed on the entire surface of the front glass substrate 11 so as to cover the scan electrode group SCN and the sustain electrode group SUS. A lead glass having a low melting point is typically used for the dielectric layer 13, though a bismuth glass having a low melting point or a lamination of the lead glass and the bismuth glass is applicable too.

The protective layer 14 is a thin film of magnesium oxide (MgO), and covers the entire surface of the dielectric layer 13.

The barrier ribs 30 are formed on the surface of the dielectric layer 23 in the back panel 20, and separate the discharge spaces 40.

Figure 2:
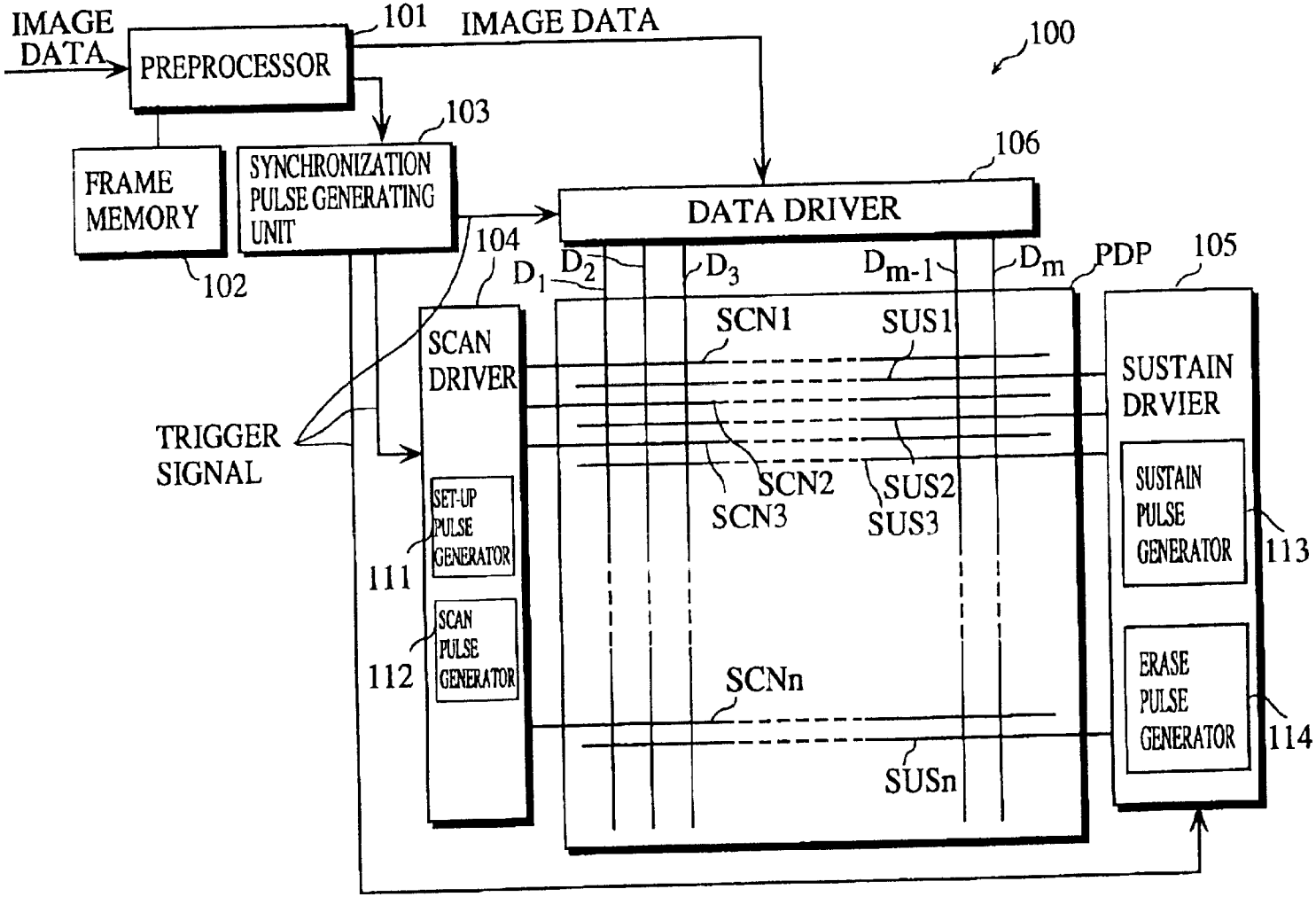
FIG. 2 is a block diagram showing a construction of a drive device to which an embodiment of the invention relate.

FIG. 2 is a block diagram showing a construction of a display device for the above described PDP.

An electrode matrix is explained first.

In the PDP shown in FIG. 2, the scan electrode group SCN and the sustain electrode group SUS are arranged orthogonal to the data electrode group D. In the gap between the front glass substrate 11 and the back glass substrate 21, the points where the scan and sustain electrodes cross over the data electrodes are discharge cells. Adjacent discharge cells are separated by the barrier ribs 30, so as to suppress discharge diffusion between adjacent discharge cells.

A drive device 100 which is connected to this PDP is explained next. Here, the PDP is driven using the field timesharing gradation display method. According to this method, one field is made up of a set-up period and a predetermined number of sub-fields (each being made up of a write period, a sustain period, and an erase period) that follow the set-up period. Repeating an operation for one sub-field the predetermined number of times (e.g. eight times) produces a one-field image display.

The drive device 100 includes a preprocessor 101 for processing image data input from an external image output device, a frame memory 102 for storing the processed image data, a synchronization pulse generating unit 103 for generating a synchronous pulse for each field and sub-field, a scan driver 104 for applying pulses to the scan electrode group SCN, a sustain driver 105 for applying pulses to the sustain electrode group SUS, and a data driver 106 for applying pulses to the data electrode group D.

The preprocessor 101 extracts image data of each field (field image data) from the input image data, generates image data of each sub-field (sub-field image data) from the extracted field image data, and stores the sub-field image data in the frame memory 102.

The preprocessor 101 also outputs current sub-field image data stored in the frame memory 102 line by line to the data driver 106. The preprocessor 101 further detects synchronization signals such as horizontal synchronization signals and vertical synchronization signals from the input image data, and sends synchronization signals for each field and sub-field to the synchronization pulse generating unit 103.

The frame memory 102 is a two-port frame memory provided with two memory areas each capable of storing one field of data (eight sub-field images). An operation in which image data for one field is written in one memory area while image data for another field written in the other memory area is read can be performed alternately on the memory areas.

The synchronization pulse generating unit 103 generates trigger signals indicating the timing of the leading edge of each of the set-up, scan, sustain, and erase pulses, with reference to the synchronization signals received from the preprocessor 101 regarding each field and each sub-field. The synchronization pulse generating unit 103 sends the trigger signals to the drivers 104 to 106.

The scan driver 104 has a set-up pulse generator 111 and a scan pulse generator 112. The scan driver 104 generates set-up pulses and scan pulses and applies them to the scan electrode group SCN, in response to trigger signals received from the synchronization pulse generating unit 103.

The sustain driver 105 has a sustain pulse generator 113 and an erase pulse generator 114. The sustain driver 105 generates sustain pulses and erase pulses and applies them to the sustain electrode group SUS, in response to trigger signals received from the synchronization pulse generating unit 103.

The sustain driver 105 also applies negative pulses to the sustain electrode group SUS in the set-up period. The timing of the leading and trailing edges of the negative pulses is defined in accordance with trigger signals from the synchronization signal generating unit 103.

A set-up pulse used here is the same as that disclosed by PCT International Publication No. WO 00/30065 (Hibino). Ramp waveforms included in this set-up pulse are generated using a Miller integration circuit, though its detailed explanation is omitted here.

A drive method of the above constructed PDP display device regarding the set-up period is described below.

Figure 3:
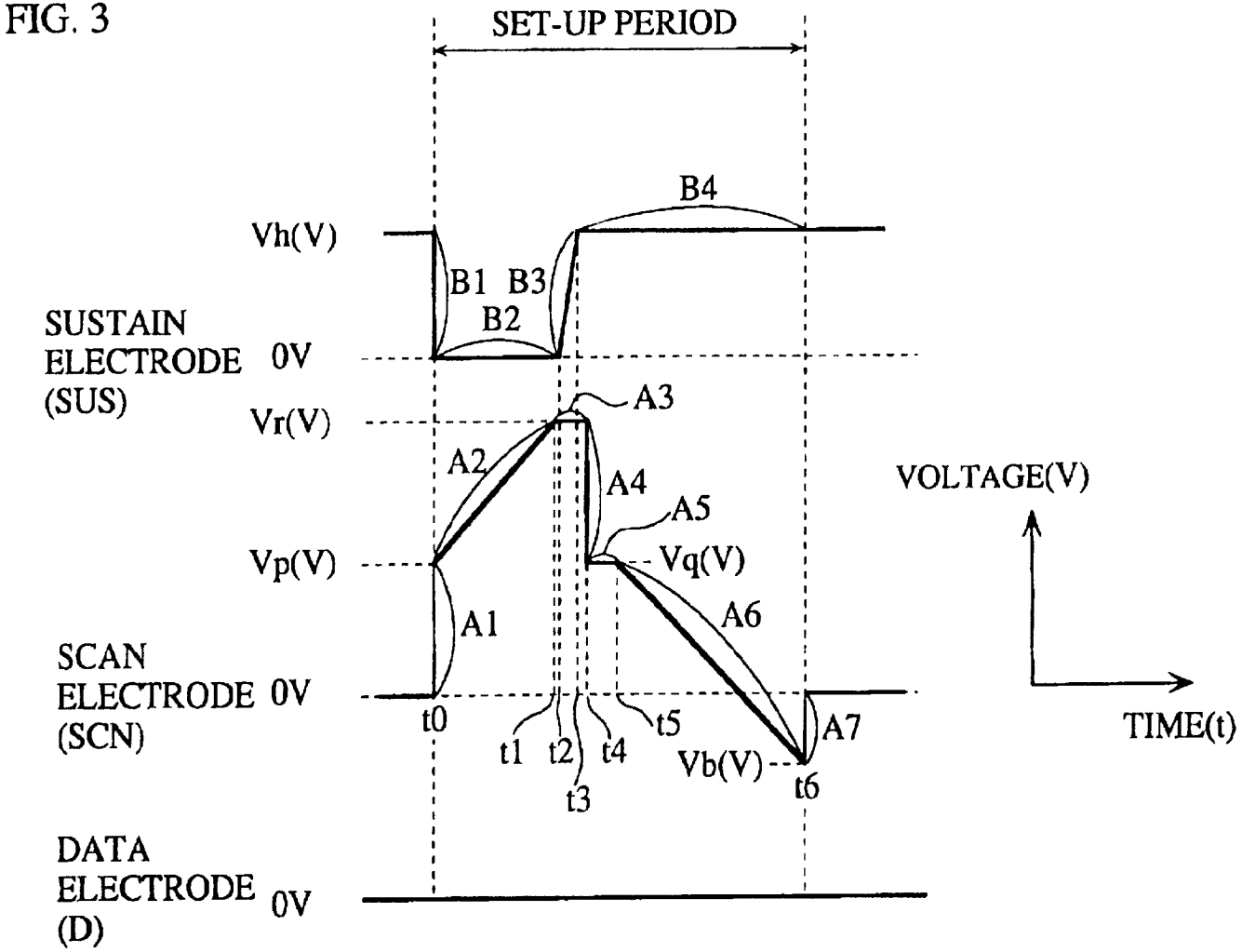
FIG. 3 shows waveforms of voltages applied in a set-up period, according to the embodiment of the invention.

FIG. 3 shows waveforms of pulses applied to each electrode in the set-up period, according to the embodiment of the invention.

In the set-up period, a waveform of a pulse applied to the sustain electrode group SUS by the sustain driver 105 can be divided into four portions B1–B4, whereas a waveform of a pulse applied to the scan electrode group SCN by the scan driver 104 can be divided into seven portions A1–A7.

Since the potential of the data electrode group D is held at 0(V) by the data driver 106 during this period, the potential difference between the scan electrode group SCN and the data electrode group D is identical to the pulse waveform applied to the scan electrode group SCN shown in the drawing. Likewise, the potential difference between the sustain electrode group SUS and the data electrode group D is identical to the pulse waveform applied to the sustain electrode group SUS shown in the drawing.

At the beginning of the set-up period (t0), the voltage applied to the sustain electrode group SUS (hereafter "sustain voltage Vsu") drops from Vh(V) to 0(V) (portion B1), whereas the voltage applied to the scan electrode group SCN (hereafter "scan voltage Vsc") rises from 0(V) to Vp(V) (portion A1). Vp(V) is a voltage that does not cause a discharge with the sustain electrode group SUS or the data electrode group D.

From t0 to t1, scan voltage Vsc takes a ramp waveform that increases from Vp(V) to Vr(V) (portion A2). Vr(V) is a voltage that causes a discharge with the sustain electrode group SUS and the data electrode group D.

Meanwhile, sustain voltage Vsu is held at 0(V) by the sustain driver 105 (portion B2).

The slope of the ramp waveform of portion A2, namely, the rate of change of voltage ((Vr−Vp)/(t1−t0)), is preferably small so that sufficient wall charges are accumulated on the protective layer 14 and dielectric layer 23 covering each electrode. As an example, the rate of change of voltage is set in a range of 1V/μsec to 10V/μsec. This being so, a first weak set-up discharge takes place between the scan electrode group SCN and the sustain electrode group SUS and between the scan electrode group SCN and the data electrode group D in each discharge cell, during this period. As a result of this discharge, negative wall charges are accumulated on the part of the protective layer 14 which covers the scan electrode group SCN, and positive wall charges are accumulated on the part of the protective layer 14 which covers the sustain electrode group SUS and on the part of the dielectric layer 23 which covers the data electrode group D.

From t1 to t4, scan voltage Vsc is held at Vr(V) (portion A3). Meanwhile, in response to a trigger signal sent from the synchronization pulse generating unit 103 to the sustain driver 105, sustain voltage Vsu rises from 0(V) to Vh(V) in the form of a ramp (portion B3) Vh (V) is a voltage that does not cause a discharge with the scan electrode group SCN or the data electrode group D. Vh (V) is typically around 150(V), but can also be set at around 50–100(V). When Vh(V) is 50–100(V), however, Vh(V) should be increased to about 150(V) in the period from t5 to t6 (corresponding to portion A6).

The rate of change of voltage (Vh/ (t3−t2)) of the ramp waveform of portion B3 is, for instance, set in a range of 30V/μsec to 200V/μsec.

Which is to say, the sustain driver 105 applies a negative pulse that decreases from Vh(V) to 0(V), to the sustain electrode group SUS during t0–t1. The trailing edge of this negative pulse lies between t2 and t4, during which sustain voltage Vsu rises from 0(V) to Vh(V).

From t3 onward, sustain voltage Vsu is held at Vh(V) by the sustain driver 105.

As can be seen from the drawing, t3 precedes t4. In other words, sustain voltage Vsu is increased from 0(V) to Vh(V), while scan voltage Vsc is kept at Vr(V).

After this, scan voltage Vsc sharply drops from Vr(V) to Vq(V) at t4 (portion A4). The rate of change of voltage at portion A4 is 2V/μsec or more. The rate is more preferably 10V/μsec or more, in order to shorten the set-up period. Vq(V) is a voltage which does not cause a discharge with the sustain electrode group SUS or the data electrode group D, even when sustain voltage Vsu is kept at Vh(V).

Also, (Vr−Vq) in portion A4 is preferably 150(V) or above, to shorten the set-up period.

Following this, scan voltage Vsc is held at Vq(V) until t5 (portion A5).

From t5 to t6, scan voltage Vsc drops from Vq(V) to Vb(V) in the form of a ramp (portion A6). Here, the absolute value of the rate of voltage change ((Vb−Vq)/(t6−t5)) in portion A6 is smaller than that of portion A4, for example in a range of 1V/μsec to 10V/μsec. In portion A6, a second weak set-up discharge takes place between the scan electrode group SCN and the sustain electrode group SUS and between the scan electrode group SCN and the data electrode group D in each discharge cell. As a result of this discharge, the negative wall charges accumulated on the protective layer 13 over the scan electrode group SCN and the positive wall charges accumulated on the protective layer 13 over the sustain electrode group SUS are weakened, while the positive wall charges accumulated on the dielectric layer 23 over the data electrode group D remain as they are.

Finally, scan voltage Vsc is increased to 0(V) at t6, to complete the set-up period (portion A7).

Although scan voltage Vsc is increased to 0(V) in portion A7 in this embodiment, this is not a limit for the invention, so long as scan voltage Vsc is increased to a voltage that does not cause a discharge between the data electrode group D and the scan electrode group SCN when a data pulse is applied to the data electrode group D.

According to the above drive method, portions A2 and A6 facilitate the accumulation of wall charges, while portions A1 and A4 facilitate the shortening of the set-up period. Therefore, by using a waveform that combines portions A2 and A6 and portions A1 and A4 as a set-up pulse, sufficient wall charges can be accumulated without prolonging the set-up period.

Figure 6:
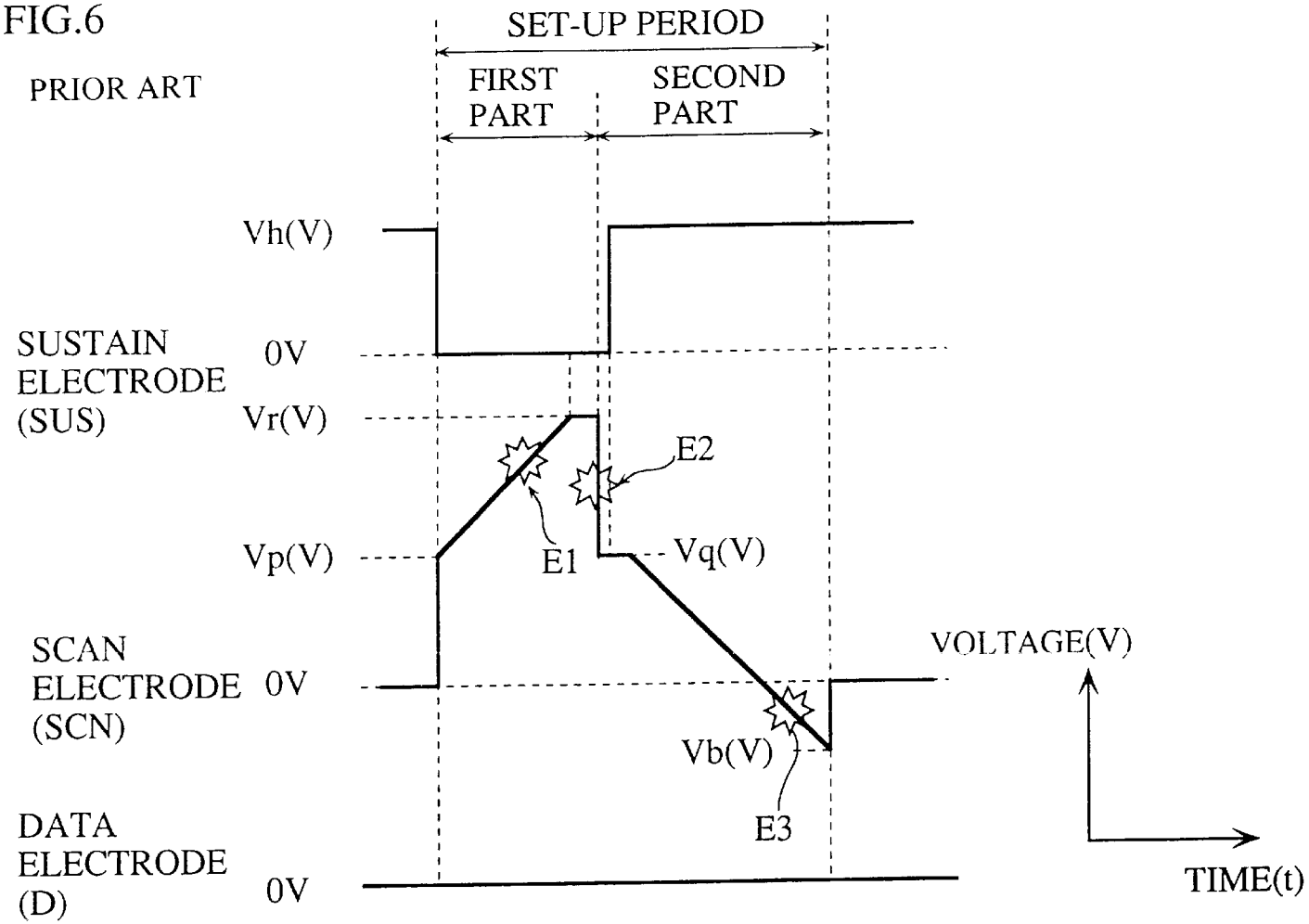
FIG.6 PRIOR ART
FIG. 6 shows waveforms of voltages applied in the set-up period, according to a conventional drive method.

This effect of accumulating wall charges is similar to that explained in FIG. 6, but the embodied drive method further delivers the following effects.

The drive method increases sustain voltage Vsu from 0(V) to Vh(V) prior to t3. Accordingly, even if wall charges accumulated in the previous field are not sufficiently erased in the erase period and excess wall charges remain on some or all electrodes in the setup period, discharge errors will not occur between the scan electrode group SCN and the sustain electrode group SUS, in portions A4 and A6.

The reason for this is given below. In FIG. 3, the potential difference between the scan electrode group SCN and the sustain electrode group SUS at voltage drop portion A4 is (Vr−Vh) (V), which is Vh(V) smaller than the potential difference Vr(V) in FIG. 6.

Accordingly, the PDP display device utilizing this drive method can prevent the occurrence of discharge errors in the set-up period which would induce discharge errors in the sustain period.

The above embodiment is merely an example of the present invention, and the invention should not be limited to the embodiment. For instance, the embodiment describes the case where portion B3 in which sustain voltage Vsu rises from 0(V) to Vh(V) overlaps in time with portion A3 in which scan voltage Vsc is held at Vr(V), but portion B3 may begin before t1, so long as it begins substantially after the first weak set-up discharge starts.

Also, the embodiment describes the case where scan voltage Vsc sharply drops in portion A4, but the effect of shortening the set-up period can be attained so long as the voltage change rate of portion A4 is 2V/μsec or more and is greater than that of portion A6. It should be noted however that the voltage change rate of portion A4 is preferably 10V/μsec or above.

Also, the voltage change rates of the ramp waveforms of portions A2, A6, and B3 shown in FIG. 3 are not limited to the above presented figures. To suppress discharge errors, these voltage change rates are preferably small so long as the acceptable limit of the set-up period allows.

(Modification 1)

Figure 4:
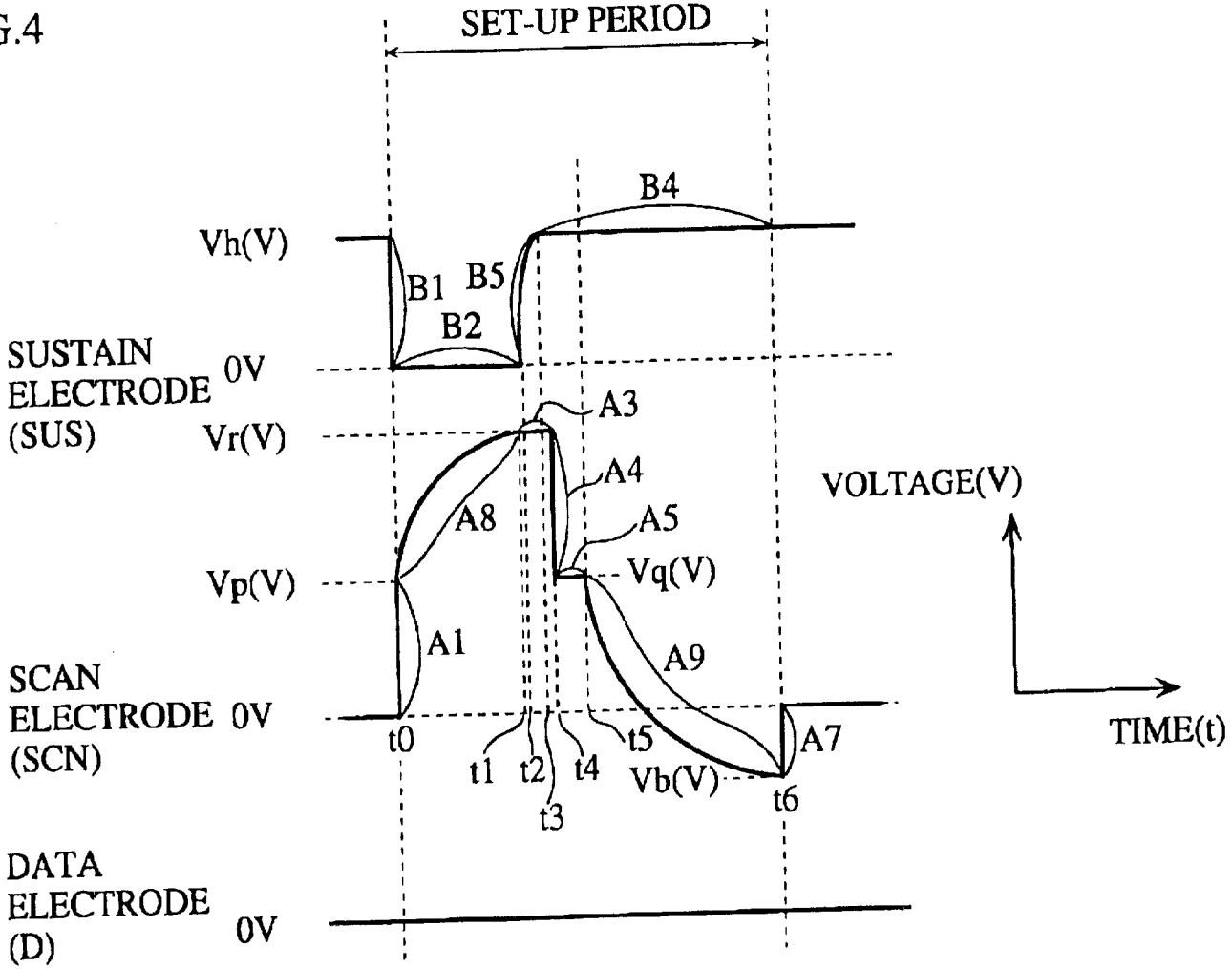
FIG. 4 shows waveforms of voltages applied in the set-up period, according to a modification 1.

FIG. 4 shows waveforms of pulses applied to each drive method of the invention.

While portions A2, A6, and B3 have ramp waveforms in the above embodiment, they have exponential waveforms in the modification 1 as shown in FIG. 4.

In the drawing, the time constant of portion AS in scan voltage Vsc is set in a range of 20 μsec to 100 μsec, and the time constant of portion A9 is set in a range of 30 μsec to 300 μsec.

Also, the time constant of portion B5 in sustain voltage Vsu is set in a range of 0.75 μsec to 5 μsec.

The voltage waveforms of the other portions in the set-up period are the same as those shown in FIG. 3.

Setting such time constants assists optimal accumulation of wall charges. In other words, by setting the time constants in this way, the occurrence of discharge errors at the time of voltage change can be prevented.

According to this drive method, portions A8 and A9 facilitate the accumulation of wall charges, while portions A1 and A4 facilitate the shortening of the set-up period, as in the embodiment. Therefore, by using a waveform that combines portions A8 and A9 and portions A1 and A4 as a set-up pulse, a set-up can be achieved where sufficient wall charges are accumulated without lengthening the set-up period.

Also, this drive method increases sustain voltage Vsu from 0(V) to Vh(V) prior to t3. Accordingly, even if wall charges accumulated in the previous field are not sufficiently erased in the erase period and excess wall charges remain on some or all electrodes in the set-up period, discharge errors will not occur between the scan electrode group SCN and the sustain electrode group SUS, in portions A4 and A9.

The above effects are fundamentally the same as those obtained in the embodiment. However, the use of the exponential waveforms in the modification 1 has an additional effect of simplifying a drive circuit construction when compared with the use of the ramp waveforms in the embodiment, with it being possible to reduce manufacturing costs.

The time constants used here are preferably small so long as the acceptable limit of the set-up period allows.

Though sustain voltage Vsu is increased to Vh(V) in portion. B5 in this modification, sustain voltage Vsu may be increased to a lower voltage (e.g. about 50–100(V)) in portion B5, and then increased to Vh(V) in the form of staircase at the end of the set-up period.

(Modification 2)

Figure 5:
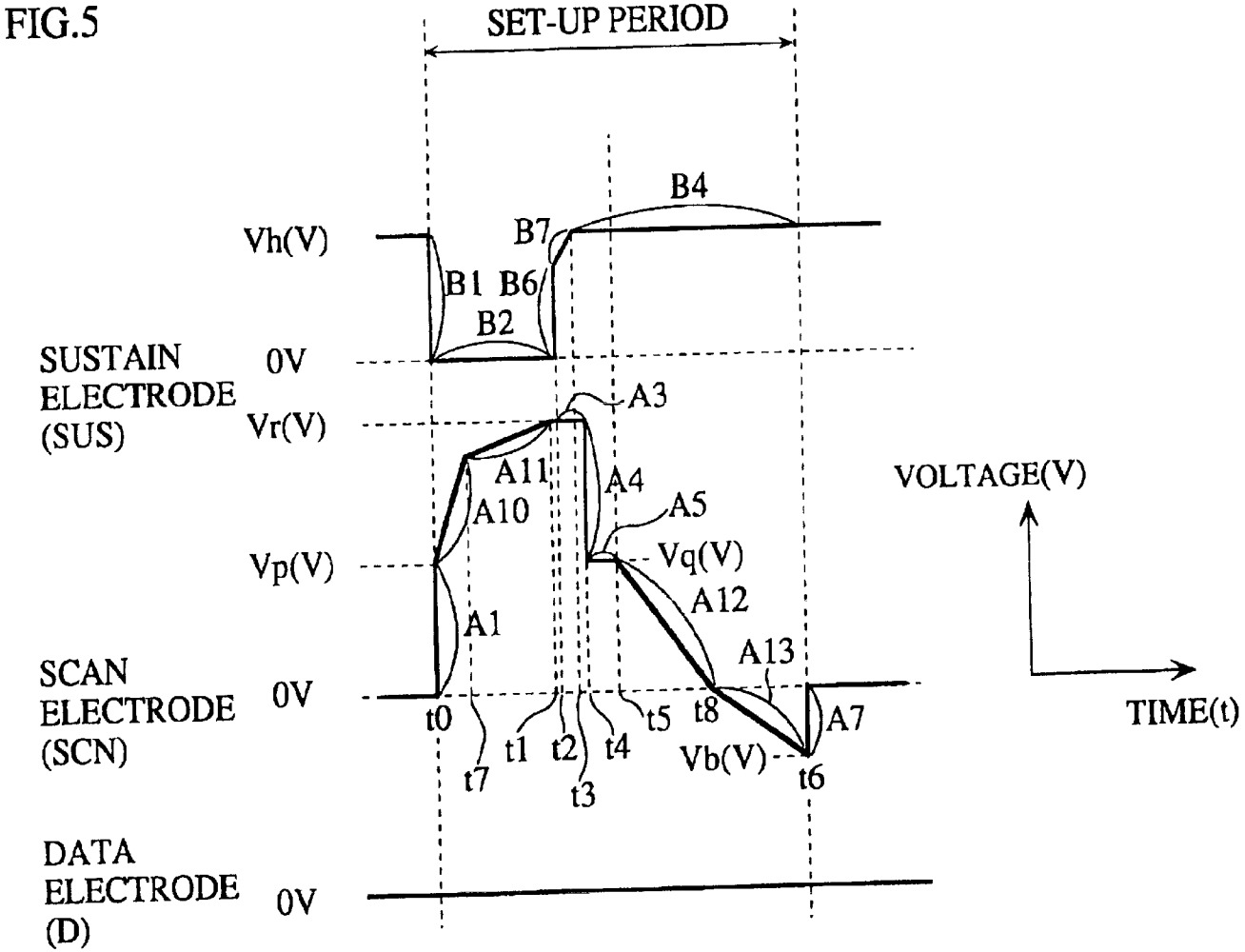
FIG. 5 shows waveforms of voltages applied in the set-up period, according to a modification 2.

FIG. 5 shows waveforms of pulses applied to each electrode in the set-up period, according to another modified drive method of the invention.

In the drawing, the exponential waveforms of the modification 1 have been replaced by combinations of ramp waveforms.

More specifically, the waveform of scan voltage Vsc from t0 to t1 includes a combination of two ramp waveforms, namely, ramp waveform 1 (portion A10) from t0 to t7 and ramp waveform 2 (portion A11) from t7 to t1. There is no gap between waveforms 1 and 2 at t7.

Also, these two ramp waveforms have a maximum rate of change of voltage of 10V/μsec or below, to suppress discharge errors as explained above.

Similarly, the waveform of scan voltage Vsc from t5 to t6 and the waveform of sustain voltage Vsu from t2 to t3 are each a combination of two ramp waveforms. Their maximum voltage change rates are respectively 10V/μsec or below and 200V/μsec or below.

The voltage waveforms of the other portions are the same as those in the above embodiment.

According to this drive method, portions A11 and A13 facilitate the accumulation of wall charges, while portions A10, A4, A12, and B6 facilitate the shortening of the set-up period. Therefore, by using a set-up pulse that combines these waveforms, a set-up can be performed where sufficient wall charges are accumulated without lengthening the set-up period.

Also, this drive method increases sustain voltage Vsu from 0(V) to Vh(V) prior to t3. In so doing, even when wall charges accumulated in the previous field are not sufficiently erased in the erase period and excess wall charges remain on some or all electrodes in the set-up period, discharge errors will not occur between the scan electrode group SCN and the sustain electrode group SUS, in portions A4, A12, and A13.

The above effects are fundamentally the same as those in the above embodiment. However, the use of the ramp waveform combinations of this modification greatly improves the flexibility in forming a waveform of a set-up pulse. For instance, by using waveforms of small voltage change rates for portions where discharge errors are likely to occur while using waveforms of large voltage change rates for the other portions, discharge errors can be effectively suppressed without increasing the set-up period.

Though the modification 2 uses a combination of two ramp waveforms, a combination of three or more waveforms is applicable too.

Note here that ramp waveform combinations need not be used where unnecessary.

Though sustain voltage Vsu is increased to Vh(V) in portion B7 in this modification, sustain voltage Vsu may be increased to a lower voltage (e.g. 50–100(V)), and then increased to Vh(V) in the form of staircase at the end of the set-up period.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A display device comprising:

a plasma display panel having a first row electrode, a second row electrode, and a column electrode, with a discharge cell being formed where the first and second row electrodes cross over the column electrode; and a drive circuit which drives the plasma display panel to emit light by applying pulses to each electrode, where a set-up period for performing a set-up for each field or sub-field and write and sustain periods for writing data and sustaining a discharge based on input image data are repeated, wherein a pulse applied to the first row electrode in the set-up period includes a drop portion in which the pulse decreases in voltage at a rate no smaller than 2V/μsec, and a pulse applied to the second row electrode in the set-up period includes the following portions in the stated order:

a first portion in which the pulse increases to a predetermined voltage before the drop portion starts, the predetermined voltage being a voltage which does not cause a discharge between the first and second row electrodes; and a second portion in which the pulse is held at the predetermined voltage after the drop portion starts.

2. The display device of claim 1, wherein the pulse applied to the first row electrode in the set-up period includes the following portions in the stated order:

a third portion in which the pulse increases from a first voltage to a second voltage, the first voltage being a voltage that does not cause a discharge between the first and second row electrodes, and the second voltage being a voltage that causes a discharge between the first and second row electrodes;

a fourth portion in which the pulse is held at the second voltage; and a fifth portion which includes the drop portion and in which the pulse decreases from the second voltage to a third voltage, the third voltage being a voltage that causes a discharge between the first and second row electrodes in a direction opposite to the discharge caused by the second voltage, and the pulse applied to the second row electrode in the set-up period includes the first portion which overlaps in time with at least one of the third portion and the fourth portion, and in which the pulse increases from a fourth voltage to the predetermined voltage, the fourth voltage being a voltage that causes a discharge between the first and second row electrodes.

3. The display device of claim 2, wherein at least one of the first portion, the third portion, and the fifth portion includes a ramp waveform.

4. The display device of claim 3, wherein the third portion includes a ramp waveform that varies at a rate in a range of 2V/μsec to 10V/μsec.

5. The display device of claim 3, wherein the fifth portion includes a ramp waveform that varies at a rate in a range of 1V/μsec to 10V/μsec.

6. The display device of claim 3, wherein the first portion includes a ramp waveform that varies at a rate in a range of 30V/μsec to 200V/μsec.

7. The display device of claim 2, wherein at least one of the first portion, the third portion, and the fifth portion includes an exponential waveform.

8. The display device of claim 7, wherein the third portion includes an exponential waveform whose time constant is in a range of 20 μsec to 100 μsec.

9. The display device of claim 7, wherein the fifth portion includes an exponential waveform whose time constant is in a range of 30 μsec to 300 μsec.

10. The display device of claim 7, wherein the first portion includes an exponential waveform whose time constant is in a range of 0.75 μsec to 5 μsec.

11. The display device of claim 2, wherein at least one of the first portion, the third portion, and the fifth portion includes a combination of ramp waveforms that each vary at a different rate.

12. The display device of claim 11, wherein the third portion includes a combination of ramp waveforms that vary at a maximum rate in a range of 2V/μsec to 10V/μsec.

13. The display device of claim 11, wherein the fifth portion includes a combination of ramp waveforms that vary at a maximum rate in a range of 1V/μsec to 10V/μsec.

14. The display device of claim 11, wherein the first portion includes a combination of ramp waveforms that vary at a maximum rate in a range of 30V/μsec to 200V/μsec.

15. The display device of claim 2, wherein the decrease from the second voltage to the third voltage in the fifth portion passes through a sixth voltage that does not cause a discharge between the first and second row electrodes.

16. The display device of claim 2, wherein the fifth portion starts a predetermined period after the first portion ends, the predetermined period being in a range of 2 μsec to 20 μsec.

17. A drive method used in a display device that includes: a plasma display panel having a first row electrode, a second row electrode, and a column electrode, with a discharge cell being formed where the first and second row electrodes cross over the column electrode; and a drive circuit which drives the plasma display panel to emit light by applying pulses to each electrode, where a set-up period for performing a set-up for each field or sub-field and write and sustain periods for writing data and sustaining a discharge based on input image data are repeated, wherein a pulse applied to the first row electrode in the set-up period includes a drop portion in which the pulse decreases in voltage at a rate no smaller than 2V/μsec, and a pulse applied to the second row electrode in the set-up period includes the following portions in the stated order:

a first portion in which the pulse increases to a predetermined voltage before the drop portion starts, the predetermined voltage being a voltage which does not cause a discharge between the first and second row electrodes; and a second portion in which the pulse is held at the predetermined voltage after the drop portion starts.

18. The drive method of claim 17, wherein the pulse applied to the first row electrode in the set-up period includes the following portions in the stated order:

a third portion in which the pulse increases from a first voltage to a second voltage, the first voltage being a voltage that does not cause a discharge between the first and second row electrodes, and the second voltage being a voltage that causes a discharge between the first and second row electrodes;

a fourth portion in which the pulse is held at the second voltage; and a fifth portion which includes the drop portion and in which the pulse decreases from the second voltage to a third voltage, the third voltage being a voltage that causes a discharge between the first and second row electrodes in a direction opposite to the discharge caused by the second voltage, and the pulse applied to the second row electrode in the set-up period includes the first portion which overlaps in time with at least one of the third portion and the fourth portion, and in which the pulse increases from a fourth voltage to the predetermined voltage, the fourth voltage being a voltage that causes a discharge between the first and second row electrodes.

19. The drive method of claim 18, wherein at least one of the first portion, the third portion, and the fifth portion includes one out of: a ramp waveform; an exponential waveform; and a combination of ramp waveforms which each vary at a different rate.

* * * * *